United States Patent [19]

Morris et al.

[11] 4,423,527

[45] Jan. 3, 1984

[54] FABRICATED FLOOR DRAIN WITH COMBINATION ANCHORING AND SEEPAGE CONTROL FLANGE

[75] Inventors: Earl L. Morris, La Habra Heights; V. Walter Hafner, Whittier, both of Calif.

[73] Assignee: Acorn Engineering, Industry, Calif.

[21] Appl. No.: 428,405

[22] Filed: Sep. 29, 1982

[51] Int. Cl.[3] ..... E03C 1/26

[52] U.S. Cl. ..... 4/288; 52/63

[58] Field of Search ..... 4/286–295, 4/275–279; 285/42, 56–59; 52/126.2, 247, 11, 63; 220/3.4, 3.7; 210/348

[56] References Cited

U.S. PATENT DOCUMENTS

| | | | |
|---|---|---|---|
| 1,749,878 | 3/1930 | Fleming | 4/286 |
| 1,766,621 | 6/1930 | Fleming | 4/286 |
| 2,783,852 | 3/1957 | Sisk | 4/292 |
| 2,885,689 | 3/1959 | Morris | 4/286 |
| 3,438,066 | 4/1969 | Morris | 4/288 |
| 3,711,874 | 1/1973 | Gajer | 4/287 |
| 3,713,539 | 1/1973 | Thompson | 4/286 |
| 3,844,440 | 10/1974 | Hadfield et al. | 220/3.7 |

OTHER PUBLICATIONS

Smith, p. 9755, "Special Purpose Drains".

*Designers Choice* Leaflet.

*Josam Catalog*, p. 107, "Floor Drains Offer Exclusive Features".

*Primary Examiner*—Stephen Marcus

*Assistant Examiner*—Kenneth S. Putnam

*Attorney, Agent, or Firm*—Edgar W. Averill, Jr.

[57] ABSTRACT

A fabricated floor drain for waste reception. The drain has a receptor body having an outwardly extending top rim and a flange which extends outwardly about the entire exterior of the side walls of the body. The flange functions both to anchor the drain as well as to provide a seal for a water proof membrane. Seepage drain holes are positioned at the intersection of the flange and side walls.

12 Claims, 7 Drawing Figures

FABRICATED FLOOR DRAIN WITH COMBINATION ANCHORING AND SEEPAGE CONTROL FLANGE

BACKGROUND OF THE DISCLOSURE

The field of the invention is waste drains and the invention relates more particularly to waste drains which are also capable of functioning as waste receptors. Modern plumbing codes typically require indirect waste receptors in restaurants, food processing plants and other areas where food is handled or processed. Such waste receptors are also useful as floor sinks since the receptor has a body which is capable of retaining a portion of solid waste away from the floor and yet collecting them prior to their entry into the waste system. Such waste receptors are capable of holding strainers and buckets which assist in this function.

Most plumbing codes required the waste receptor to have a smooth, easy to clean, corrosion resistant interior surface and the typical cast floor drain does not meet this requirement because such drains have rough interiors with pockets and crevices which can harbor dirt and bacteria.

Another problem associated with waste drains is the leakage of waste around the exterior of the drain. Such leakage is quite common in concrete floors where cracks caused by shrinkage usually exists and flashing has been used in the past to assist in reducing this problem. The problem is particularly acute where the drain is on a second or higher floor since leakage will often find its way through the ceiling below.

A drainage receptor which appears to be cast is shown in U.S. Pat. No. 3,713,539 and, as pointed out above, such drains do not typically have the requisite smooth surfaces to prevent harboring of bacteria and the like. Furthermore the drain has no provision for collection of fluids which have seeped around the outside of the drain. Seepage prevention means are quite commonly provided in drains which do not have receptors and examples of various methods of controlling seepage are shown in U.S. Pat. Nos. 2,885,689 to Morris; 1,766,621 to Flemming; and 1,749,879 to Flemming. The seepage control methods shown in the above patents however are not readily adopted to waste receptors and a better device for providing seepage control in waste receptors is needed.

SUMMARY OF THE INVENTION

It is an object of the present invention to provide an improved waste receptor.

It is another object of the present invention to provide a waste receptor with means for effectively controlling seepage.

The present invention is for a fabricated floor drain for waste reception. The drain has a receptor body having an outwardly extending top rim around the top thereof, side walls and a bottom outlet. Flange means are sealingly affixed about the entire exterior of the side walls of the receptor body at a point below and parallel to the top rim. The flange means has a generally flat and inwardly sloped shelf portion which extends outwardly away from the receptor body. At least one weep hole is located in a side wall of the receptor body just above the point at which the flange means is connected to the wall. Membrane clamp means are pressed against the under surface of the top rim and have at least one clamp bar which abuts the upper surface of the flat shelf portion of the flange means at one end and the under surface of the top rim at its other end. Preferably the receptor body is rectangular and there are four clamp bars, one along each side of the receptor body. The clamp bar may be urged against a water proof membrane which is held between the bar and the shelf portion of the flange and the bar may be locked in place by a plurality of nuts threaded onto studs which are affixed to the clamp bars. The receptor is designed to permit the inclusion of a grate as well as a sediment bucket and a dome shaped bottom strainer.

DESCRIPTION OF THE PREFERRED EMBODIMENTS

Figure 1:
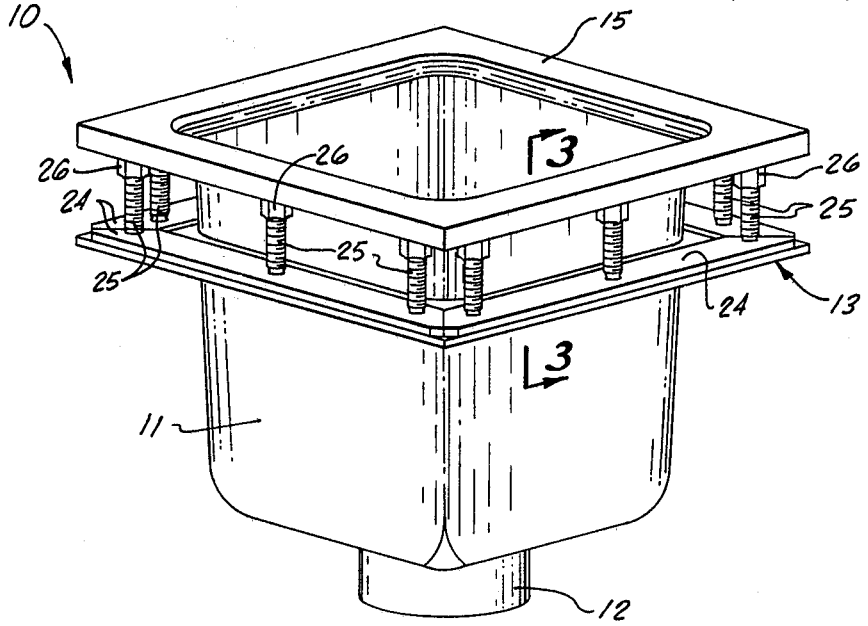
FIG. 1 is a perspective view of the fabricated floor drain in the present invention.

The floor drain of the present invention is shown in perspective view in FIG. 1 and indicated generally by reference character 10. Drain 10 has a waste receptor body 11 which is generally square in cross section. Body 11 should be fabricated in a manner so that the interior thereof is smooth and free of crevices, cracks and other areas for harboring bacteria. The body of the drain in the present invention may be deep drawn from a single piece and only the bottom outlet 12 and flange 13 need be continuously seam welded to the drawn body. The preferred material of construction is 14 gauge type 304 stainless steel although other types of stainless steel such as type 316 and other materials of construction may be used depending upon the desired strength, corrosion resistance and fabrication techniques available. The flange of the present invention need not extend further out than the top rim.

Figure 2:
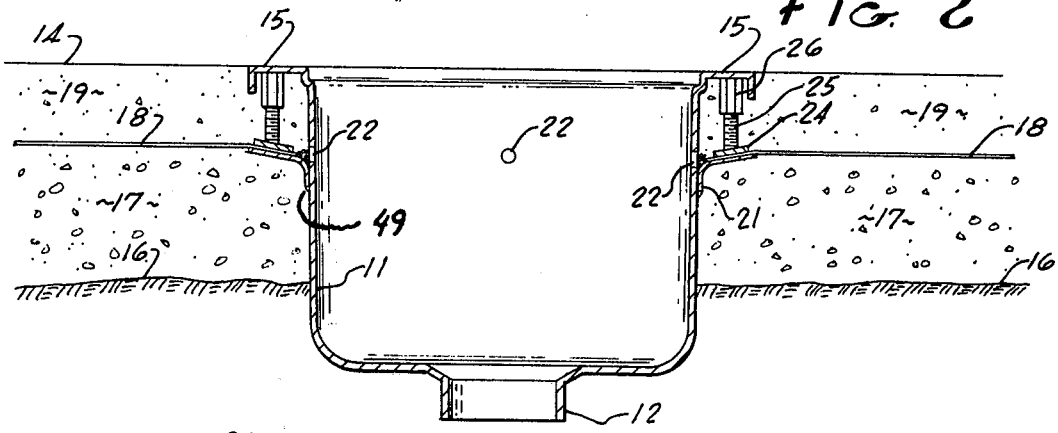
FIG. 2 is a cross sectional side elevation of the drain in FIG. 1 installed in a floor.

The drain, after installation on grade in a concrete floor is shown in cross sectional view in FIG. 2. The surface of the floor is indicated by reference character 14 which is in the same plane as the upper surface of rim 15 of the drain. The bottom outlet 12 is, of course, connected to a drain pipe (not shown). Because of the tendency of concrete to expand and contract at the intersection of the drain rim and the concrete, some means is necessary to intercept such leakage and convey it to the interior of the drain. As pointed out above, this need is particularly acute when the drain is installed above grade.

The drain body 11 rests in the ground 16 and a layer of sand and gravel 17 supports a water impervious membrane 18 of the type commonly used in building construction to prevent water seepage into the ground. The concrete or other flooring 19 is placed above membrane 18.

Figure 3:
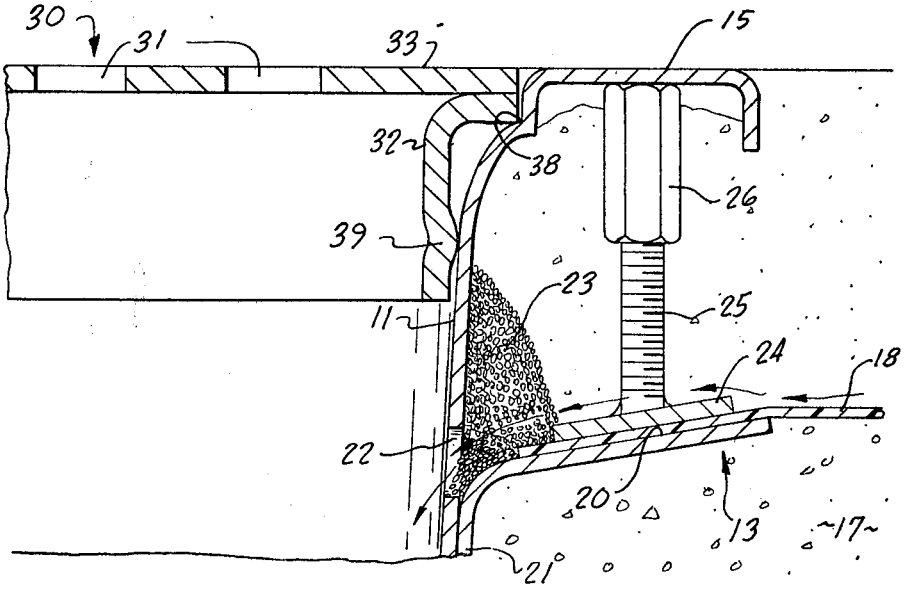
FIG. 3 is an enlarged side view taken along line 3—3 of FIG. 1.

A persistent problem in preventing water seepage about the outside of a drain body has been the means used to connect the water impervious membrane to the drain in a manner which minimizes the amount of water which can escape without passing through the bottom outlet of the drain. Elaborate clamping means such as those shown in the above-described U.S. Pat. No. 1,749,878 have been utilized but such methods have not proved practical for the larger waste receptors of the type shown in the drawing. The method for clamping the water proof membrane to the flange is shown best in FIG. 3. There it can be seen that flange 13 has a generally flat and inwardly sloped shelf portion 20 and a downwardly extending projections 21 which is continuously seam welded to the receptor body 11. Projection 21 extends around the entire periphery of the receptor body and the weld line 49 is at the bottom of projection 21. Weep holes 22 are positioned so that the lowermost point of the holes are about at the point where projection 21 meets the outer wall of receptor body 11. Preferably a small amount of gravel or other porous material 23 is added around the intersection of the flange and the drain body before the concrete is poured above the flange. This allows seepage to more readily reach the weep holes.

The clamping means used to hold water proof membrane 18 against the generally flat shelf portion 20 of flange 13 has a clamping bar 24 which is welded to a threaded stainless steel stud 25. Coupling nut 26 is screwed over the upper end of stud 25 and is screwed sufficiently far down so that the bar, stud and nut may be placed over the membrane which, in turn, has been placed on the upper surface of the generally flat shelf portion 20 of flange 13. Then, coupling nut 26 is unscrewed with respect to the stud 25 until its upper surface hits the lower surface of rim 15 at which point it forces clamping bar 24 tightly against membrane 18. The nut 26 should extend below the rim so that it may be contacted by a wrench. The advantage of this particular clamping means is many fold. First, it does not puncture or cause any leaks in the membrane itself. Secondly, because of the use of a plurality of studs 25 any lack of straightness in shelf 20 may be corrected by a flexing of the clamping bar 24. The other three clamping assemblies are identical to the one just described and all common elements have been given the same reference characters.

For most above grade installations, two pours of concrete are made. The first pour is made to the level of the bottom of the flange. The water proof membrane is then laid over the top of the first pour and clamped to the flange as described above. The second pour is then made over the membrane to the rim of the drain.

Figure 4:
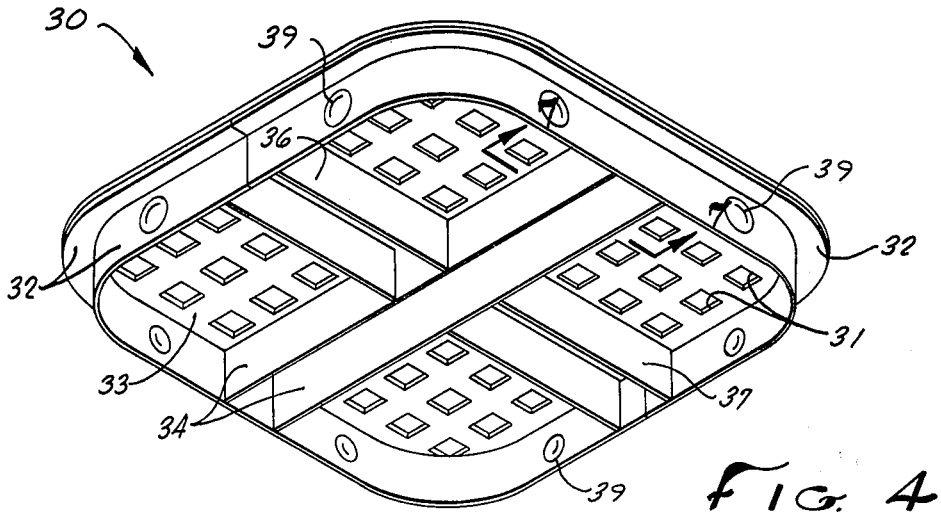
FIG. 4 is a bottom perspective view of a grate cover useful with the floor drain of FIG. 1.
Figure 7:
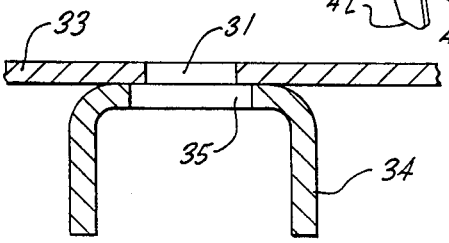
FIG. 7 is a sectional view taken along line 7—7 of FIG. 4.
Figure 6:
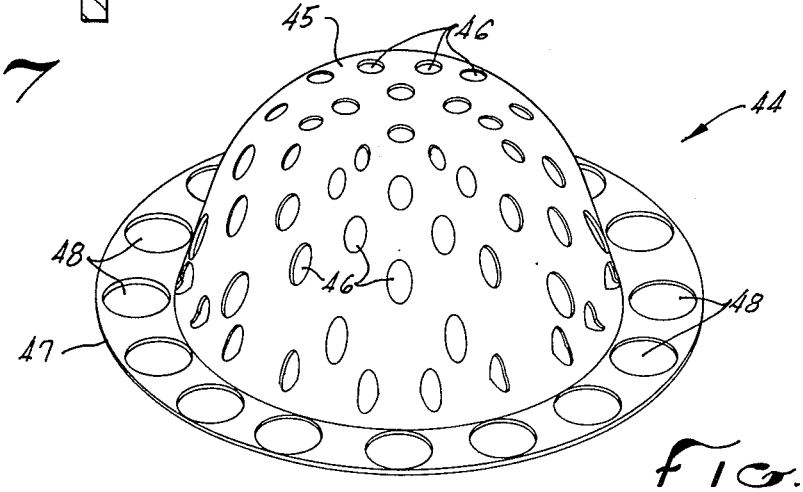
FIG. 6 is a top perspective view of a dome bottom strainer useful with the floor drain of FIG. 1.

A particularly effective cover assembly for use with the drain of the present invention is shown in FIG. 4 and indicated generally by reference character 30. This cover or grate has a plurality of openings 31 and the size and shapes of such openings are dictated by the particular end use. For instance, if it is necessary to provide a grate for grocery stores the grate should have openings which do not permit high heels to enter and a square one quarter inch opening has been considered satisfactory for this use. The grate has a reinforcing rim 32 which extends about the entire periphery thereof at a point inwardly from the edge and thus a double layer comprising the grate surface 33 and the reinforcing rim 32 exists around the entire outer edge of the apparatus. Turning back to FIG. 3 it can be seen that the upper surface of the grate can be made flush with the upper rim 15 of the drain to provide a particularly safe and attractive assembly. Reinforcing rim 32 rests on a support shelf 38 which is formed in the side wall of receptor body 11 and a plurality with dimples 39 touch the side wall 11. A channel member 34 serves as a cross brace and has a plurality of openings 35 shown in FIG. 7 which corresponds with the openings 31 in the grate. Reinforcing rim 32 also extends downwardly and has a minimum of two dimples 39 per side so as to assist in locking the grate in place, otherwise the grate might slide when stepped on and could create a hazard. Similarly channel members 36 and 37 provide bracing for the upper surface 33 of grate 30 and may likewise be provided with openings similar to openings 35.

Figure 5:
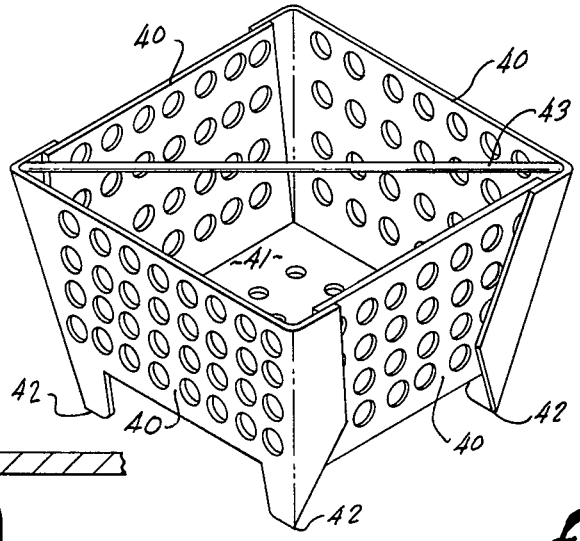
FIG. 5 is a perspective view of a sediment bucket useful with the floor drain of FIG. 1.

The waste receptor of the present invention may be readily used in combination with a sediment bucket such as that shown in FIG. 5. A particularly effective sediment bucket may be fabricated from two sheets of stainless steel and provides a bucket with side 40, a bottom 41 and 42. Feet 42 are sufficiently long so that the bottom of the bucket is above the dome strainer 44. A handle 43 facilitates removal for emptying.

Further, to decrease the possibility of any blockage of the drain pipe a dome bottom strainer 44 may be placed over the bottom outlet 12 below the sediment bucket to provide an assembly which minimizes drain blockage problems. Strainer 44 is made from a center dome 45 which has a plurality of holes 46. A ring 47 is welded to dome 44 and has a plurality of drain holes 48.

It can thus be seen that particularly effective drain assembly can result from the use of the drain receptor of the present invention. Not only can the interior of the drain be provided with rounded corners, as shown in the drawings, but the interior surface, if fabricated from a stainless steel or other satisfactory material, may be readily polished to eliminate any cracks, crevices or porosity for entrapment of bacteria. Such a drain can be used in hospitals, chemical plants, food processing plants and other areas where sanitary conditions are important. Not only does the drain reduce bacterial collection but also seepage around the flange is minimized by the membrane clamping and weep holes described above.

The flanges positioned about the periphery of the drain body not only function to collect seepage but also provide support of the drain in the concrete floor. Such flange can help anchor the device by forcing it to move up and down with the concrete thus preventing the drain from sinking slightly below the concrete surface or raising slightly above it.

While the drain in the present invention is shown as having a rectangular body and more particularly a square body it may, of course, be circular and two or more clamp bars may be utilized which, or course, would be semi-circular or otherwise correspond to the shape of the body of the drain. While the clamp bars shown in the drawings have been shown as being affixed by a plurality of studs and coupling nuts, other affixing means may be used such as one or more springs or other clamping assemblies. It is highly desirable, however, that the clamping assembly not provide any further opening in the rim 15 of the drain body as this could cause another source of seepage which is eliminated by the assembly shown in the drawings. Furthermore, the clamping system should not require a hole in the membrane or in the flange itself as this could also provide a liquid path outside of the drain body and bottom outlet.

While the studs 25 are shown as welded to bars 24, it would, of course be possible to weld the coupling nuts 26 to the bars and provide some turning means such as a hexagonal portion on the studs so that they could be screwed upwardly against the under surface of the rim. Alternatively the studs could be welded to the rim and the coupling nuts screwed into the bottom of the studs against the bars.

The present embodiments of this invention are thus to be considered in all respects as illustrative and not restrictive, the scope of the invention being indicated by the appended claims rather than by the foregoing description. All changes which come within the meaning and range of equivalency of the claims therefore are intended to be embraced therein.

What is claimed is:

1. A fabricated floor drain for waste reception comprising:

a receptor body having an outwardly extending top rim extending around the top thereof, side walls and a bottom outlet;

flange means sealingly affixed about the entire exterior of the side walls of the receptor body just above the point at which said flange means meets the wall; and membrane clamp means held against the under surface of the top rim, said membrane clamp means having two ends, the first end having at least one clamp bar which abuts the upper surface of membrane to be held against the flat shelf portion of the flange means and the second end of the clamp means being held against the under surface of the top rim and not protruding above said top rim.

2. The floor drain of claim 1 wherein said receptor body is rectangular and said clamp means has four clamp bars.

3. The floor drain of claim 2 wherein each of said clamp bars have at least one upwardly extending threaded stud affixed thereto each of said threaded studs being shorter in length than the distance between the generally flat shelf portion and the under surface of the top rim and each stud has an elongated coupling nut threaded thereon, whereby when a clamp foot is placed on the shelf portion of the flange and the coupling nut is unscrewed, the clamp bar will be urged against the shelf.

4. The floor drain of claim 3 wherein each of said clamp bars has a plurality of studs thereon.

5. The floor drain of claim 4 wherein each of said clamp bars has three studs thereon.

6. The floor drain of claim 1 wherein said flange means does not extend outwardly from the side walls further than said top rim.

7. The floor drain of claim 1 wherein said receptor body is rectangular and said projection extends around the entire outer surface of the body.

8. The floor drain of claim 7 wherein there are four weep holes.

9. The floor drain of claim 1 further including a grate having an outer support edge, said grate resting on a support shelf formed along the inner surface of the receptor body, said shelf being intergral with the body of the receptor and being positioned below the top rim a distance equal to the thickness of the grate edge.

10. The floor drain of claim 1 further including a floor which supports a sediment bucket said sediment bucket having four sides and a bottom, each of which sides and bottom has a plurality of holes passing therethrough, whereby solids too large to pass through the holes will be collected before passing through the bottom outlet of the drain.

11. The floor drain of claim 1 further including a dome shaped bottom strainer resting on the floor of the receptor above the bottom outlet thereof.

12. The floor drain of claim 9 wherein the grate has a downwardly extending reinforcing rim along each edge thereof and at least two protrusions located on each downwardly extending edge to position the grate securely on top of the drain.

* * * * *